US007287597B2

(12) United States Patent
Shaposhnikov et al.

(10) Patent No.: US 7,287,597 B2
(45) Date of Patent: Oct. 30, 2007

(54) DEVICE FOR IMPROVING OIL AND GAS RECOVERY IN WELLS

(75) Inventors: Vladimir M Shaposhnikov, Brooklyn, NY (US); Leonid Levitan, Brooklyn, NY (US); Walter Breidenstein, Boyne Falls, MI (US)

(73) Assignee: Sorowell Production Services LLC, Wallon Lake, MI (US)

( * ) Notice: Subject to any disclaimer, the term of this patent is extended or adjusted under 35 U.S.C. 154(b) by 0 days.

(21) Appl. No.: 11/442,896

(22) Filed: May 30, 2006

(65) Prior Publication Data

US 2006/0213652 A1 Sep. 28, 2006

Related U.S. Application Data

(63) Continuation-in-part of application No. 10/914,026, filed on Aug. 9, 2004, now Pat. No. 7,051,817.

(51) Int. Cl.
*E21B 43/00* (2006.01)

(52) U.S. Cl. ..... 166/372; 166/68

(58) Field of Classification Search ..... 166/68, 166/372, 105; 417/198; 66/68, 372, 105, 66/191, 380, 69

See application file for complete search history.

(56) References Cited

U.S. PATENT DOCUMENTS

| | | | | |
|---|---|---|---|---|
| 216,064 | A | | 6/1879 | Spencer |
| 1,028,822 | A | | 6/1912 | Honey |
| 1,760,420 | A | * | 5/1930 | Loomis ..... 417/54 |
| 2,061,865 | A | | 11/1936 | Wells |
| 4,051,896 | A | * | 10/1977 | Amancharla et al. ..... 166/123 |
| 5,707,214 | A | | 1/1998 | Schmidt |
| 5,743,717 | A | | 4/1998 | Schmidt |
| 5,806,599 | A | | 9/1998 | Hisaw et al. |
| 5,893,414 | A | * | 4/1999 | Shaposhnikov et al. .... 166/191 |
| 5,899,273 | A | | 5/1999 | Jung |
| 6,059,040 | A | * | 5/2000 | Levitan et al. ..... 166/372 |
| 6,352,111 | B1 | * | 3/2002 | Bode et al. ..... 166/265 |
| 6,382,321 | B1 | | 5/2002 | Bates et al. |
| 6,547,532 | B2 | | 4/2003 | Gonzalez et al. |
| 6,863,125 | B2 | | 3/2005 | Ivannikov et al. |
| 2002/0096332 | A1 | | 7/2002 | De Almeida |

* cited by examiner

*Primary Examiner*—David Bagnell
*Assistant Examiner*—David Andrews
(74) *Attorney, Agent, or Firm*—Harness, Dickey & Pierce, P.L.C.

(57) ABSTRACT

A device for improving recovery of hydrocarbons through a well is provided. The device creates, regulates and maintains a calculated bottomhole pressure at a desired level and creating above the device a two-phase gas-liquid homogenous flow for efficient lifting of hydrocarbons to a surface. The device has a body having a central through-going opening with a shape corresponding to a shape of a laval nozzle and with a cross section which changes steplessly and gradually, and a mandrel attachable to a tubing and associated with the body without interfering with a flow of fluids.

18 Claims, 14 Drawing Sheets

DEVICE FOR IMPROVING OIL AND GAS RECOVERY IN WELLS

CROSS-REFERENCE TO RELATED APPLICATIONS

This application is a continuation-in-part of U.S. patent application Ser. No. 10/914,026, filed on Aug. 9, 2004 now U.S. Pat. No. 7,051,817. The disclosure of the above application is incorporated herein by reference.

FIELD

The present disclosure relates to a device for improving oil and gas recovery in wells. It can be used in oil and gas industry for oil recovery in oil, condensate and gas fields.

BACKGROUND

The statements in this section merely provide background information related to the present disclosure and may not constitute prior art.

One device of this type is disclosed in U.S. Pat. No. 5,893,414. The device is formed as a tubular element which, by means of a mandrel, is hermetically fixed in tubing near an interval of perforation, and has a system of cavities which are connected with one another. An inlet cone opening is located downwardly and leads to a multi-stage system of coaxially arranged Venturi pipes above the inlet nozzle, with a gradually increasing diameter in direction of flow. From the side of the inlet of the flow into the device, it retains gas the calculated value of in a dissolved condition in oil at a predetermined calculated pressure. On the other hand, the device, accelerates the two-phase flow and creates homogenous structure of gas-liquid flow in upstream direction mouth the opening of the well.

The device has, however, some disadvantages. The multi-stage structure of the Venturi pipes leads to small swirling of the flow which can not be accurately calculated on transitions from one diameter of the pipe to the other. As such, this makes it difficult to correct and forecast energy losses of the flow, especially in a multi-phase systems, in the device. This in turn makes it impossible to forecast an optimal mode of operation of the current condition of the layer and the well, and the process of optimization of the system layer-bottomhole of the well-device-tubing-surface choke. The swirling zones in the device lead to formation of large drops of the liquid (oil-water mixture), which have a speed significantly smaller than the speed of the gas nucleus, and thereby they migrate in direction toward the wall of the tubing so as to create a ring-like mode in the inlet and flowing of the fluid down along the walls of the tubing to a bottom hole of the well. This, in turn, significantly increases the calculated pressure and therefore reduces efficiency of operation of the well, so as to destabilize its operation and make the process of optimization of the well longer.

Another device is disclosed in U.S. Pat. No. 6,059,040. It includes a laval nozzle which is hermetically connected with a mandrel and is located inside it, and the mandrel in turn is fixed in a column of pipes. In the narrowest point of the laval nozzle there are horizontal openings which connect the interior of the laval nozzle with a space in the tubing above a packer of the mandrel. The device can be used in gas and gas-condensate wells for removal of a liquid phase accumulated in the bottomhole (condensate and water) by creating a zone of low pressure in the narrowest part of the laval nozzle. The low pressure in this point is created by acceleration of the gas flow. The liquid phase is entrained into the gas flow and broken into small droplets with a structure in form of fog and easily travels to the surface. In the device disclosed in this reference, difficulties take place with the mounting of the device in the mandrel, since for its normal operation it is necessary to drill horizontal openings in the mandrel, which is not possible for the majority of mandrels due to their structural features.

SUMMARY

Accordingly, it is an object of the present invention to provide a device for improving oil and gas recovery in wells. In keeping with these objects and with others which will become apparent hereinafter, one feature of the present invention resides, briefly stated, in a device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device comprising a body having a central throughgoing opening with a shape corresponding a shape of a laval nozzle and with a cross section which changes steplessly and gradually; and a mandrel attachable to a tubing and associated with said body without interfering with a flow of fluids.

When the device is designed in accordance with the present invention, it allows more accurate calculations for optimization of productivity of oil-gas wells during current conditions of a joint operation of a working system layer-well.

When the device is designed in accordance with the present invention, automatic regulation of a gas-liquid flow in the device is achieved so as to provide a stable operation of the well in frequently changing conditions of operation of an interfering system of the wells, which work with a particular layer, as well as the condition of the layer within the wide range of pressures, productivity and time.

With the use of the device, a more stable multi-dispersed structure of a two-phase gas-liquid flow is created above the device and it moves to an outlet of the well in a bubble mode without deterioration into a gas-liquid, so as to reduce weight of a mixture density and to prevent formation of a ring-like mode which negatively affects the productivity of the well.

With the inventive device, parameters of the device can be calculated accurately for operation together with an outlet nipple for a smooth regulation of the system: well-bottomhole-device-tubing-outlet nipple for speedy optimization of the well in correspondence with the current condition of the layer.

Also, the device can be arranged with horizontal openings so that it enhances the most efficient withdrawal of liquid from the bottomhole of gas and gas-condensate wells.

In one embodiment, a well device is provided which is configured to be installed through well tubing into a landing nipple of the well. The device has a member defining a laval nozzle and a coupling portion fluidly coupled to the laval nozzle. A plurality of sealing members are provided which are annularly disposed about the coupling portion. The sealing members are adapted to resist movement of the coupling member with respect to the landing nipple.

In another embodiment, a well construction is provided. The Well construction has well tubing having a through bore with a first inner diameter. A landing nipple is provided which defines a second through bore having a second inner diameter smaller than the first inner diameter. The construction further has a well device having, a member defining a laval nozzle, a coupling member defining third through bore fluidly coupled to the laval nozzle. The coupling member has a plurality of compressible sealing members configured to fluidly seal the second through bore and support the coupling member in the landing nipple. The member defining the laval nozzle is disposed outside of the landing nipple.

In another embodiment, a device for improving recovery of hydrocarbons from a well is provided. The device has a body defining a central throughbore with a shape corresponding to a laval nozzle having a cross-section which is changed steplessly and gradually. A coupling mechanism is provided which is coupled to the body. The body is configured to couple the body to a well landing nipple and is located outside said well landing nipple.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 5:
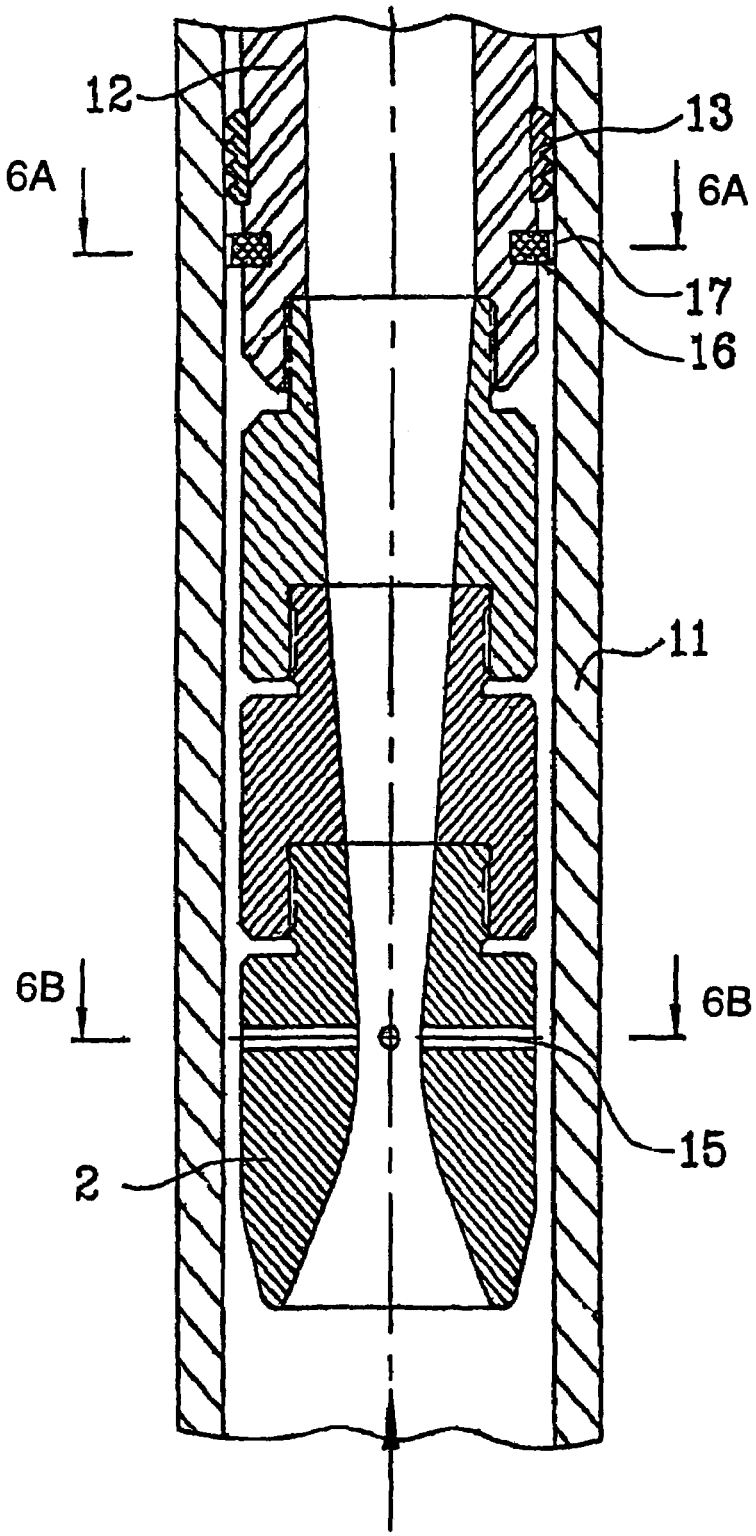
FIG. 5 is a view similar to the view of FIG. 2, but with installation under the mandrel.
Figure 6A:
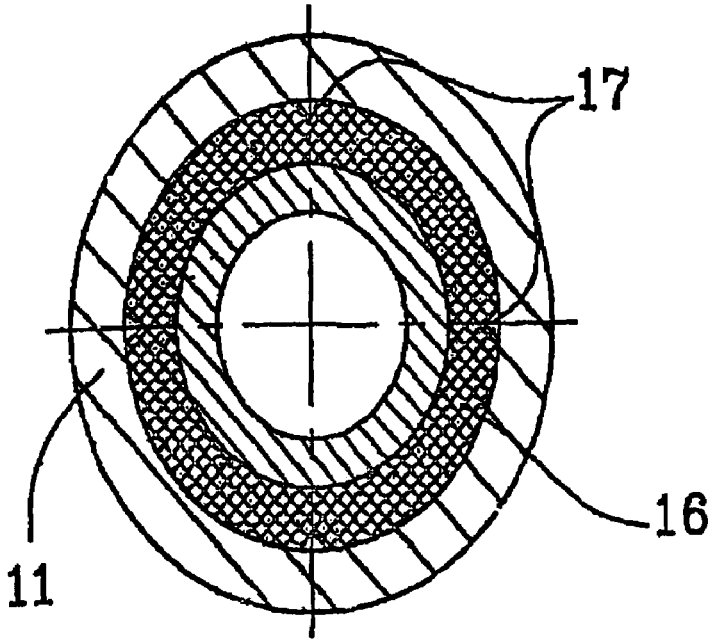
Figure 6B:
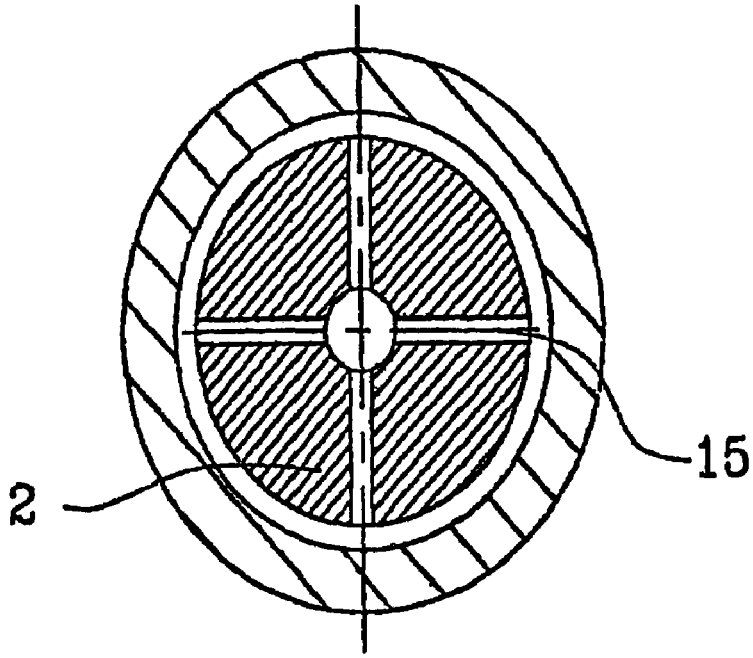
Figure 7A:
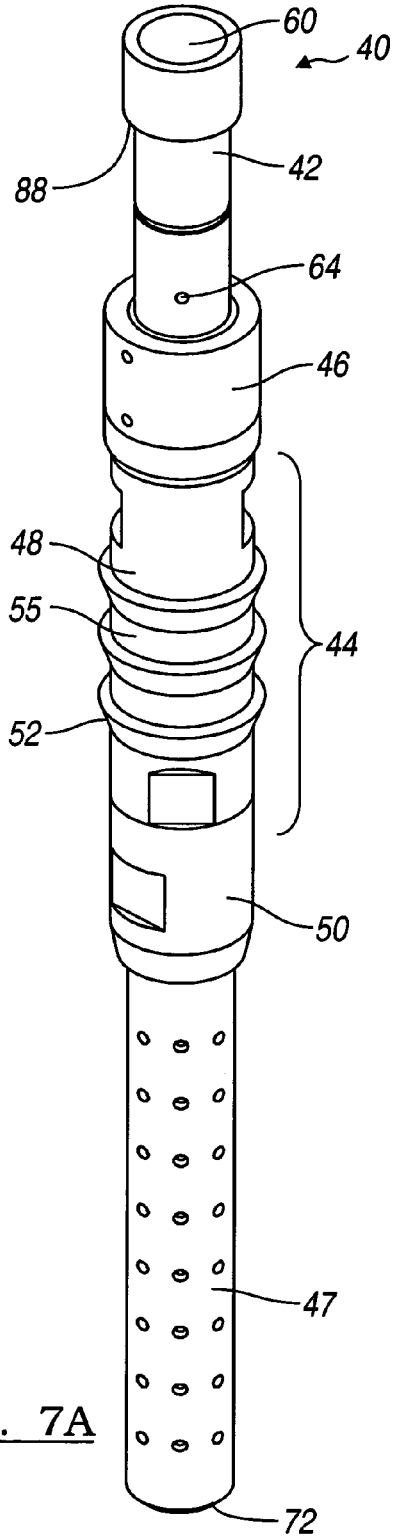
Figure 7B:
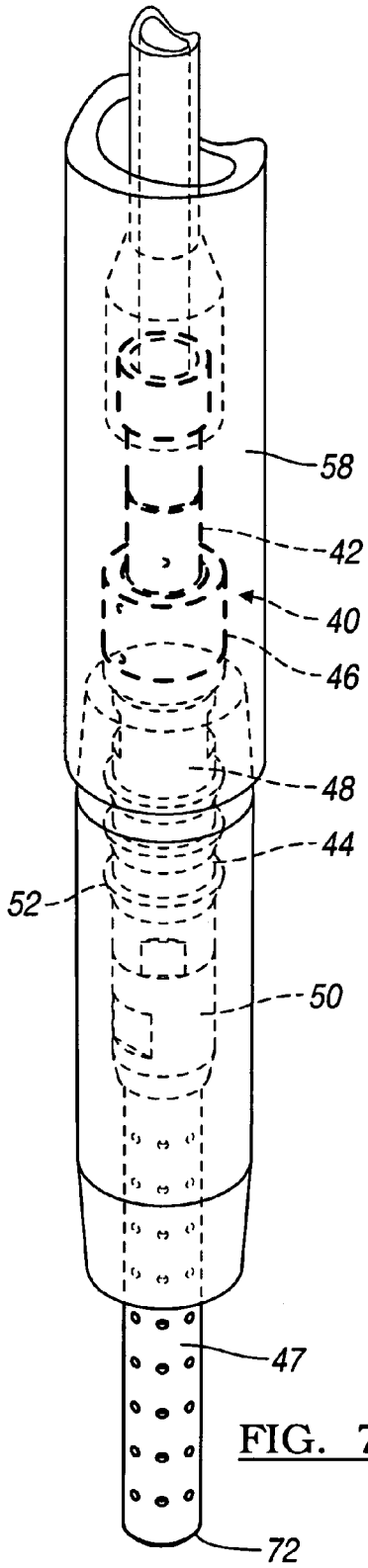
Figure 8:
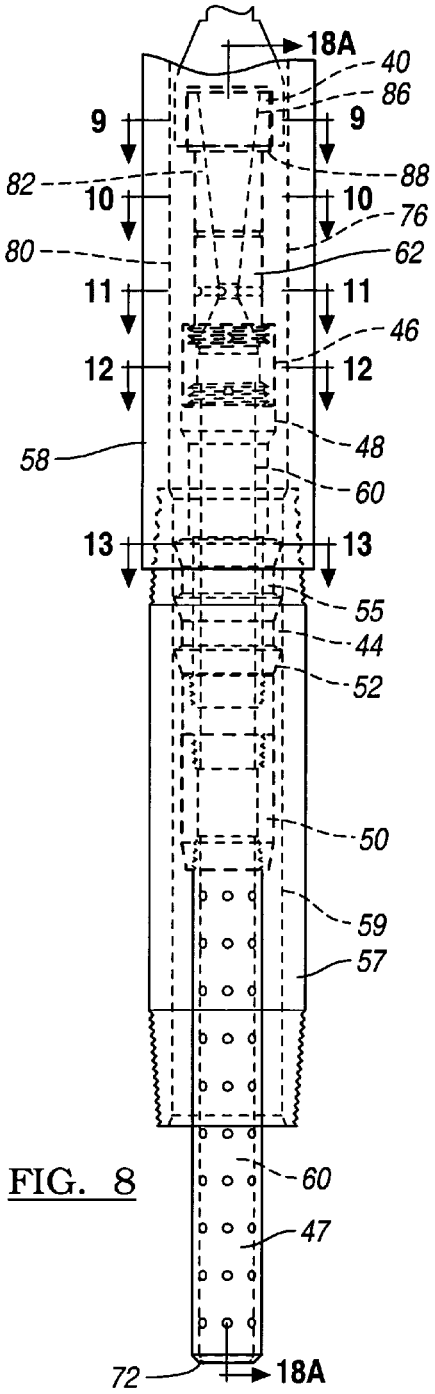
Figure 9:
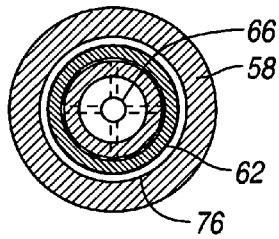
Figure 14:
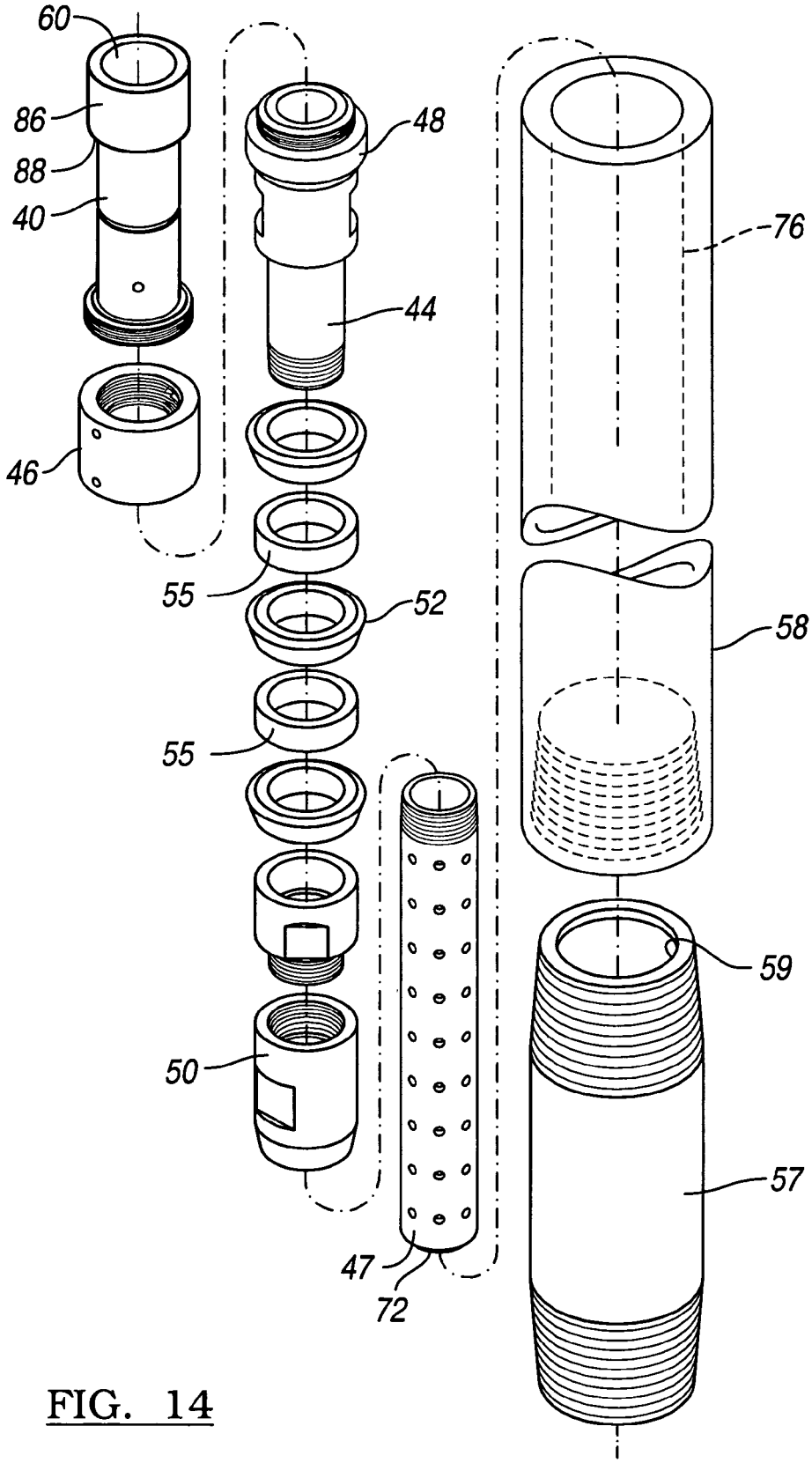
Figure 16:
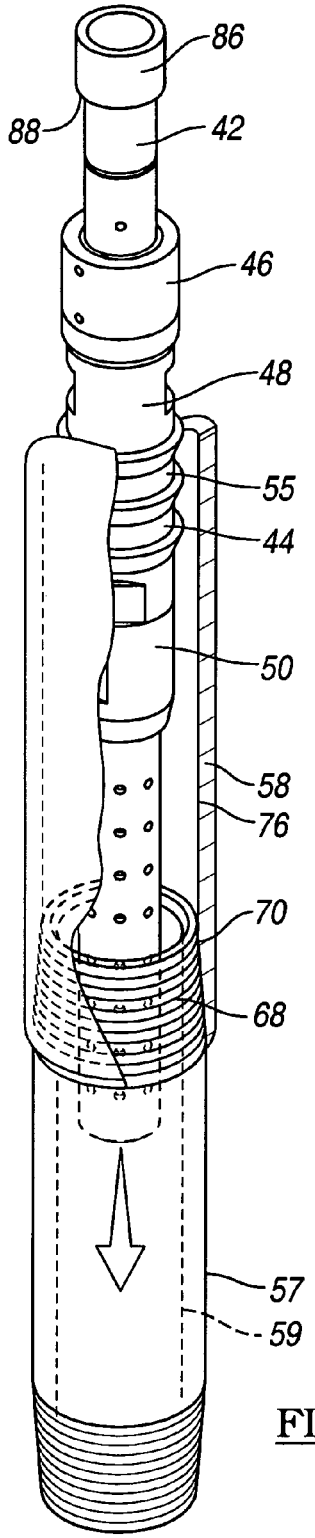
Figure 17:
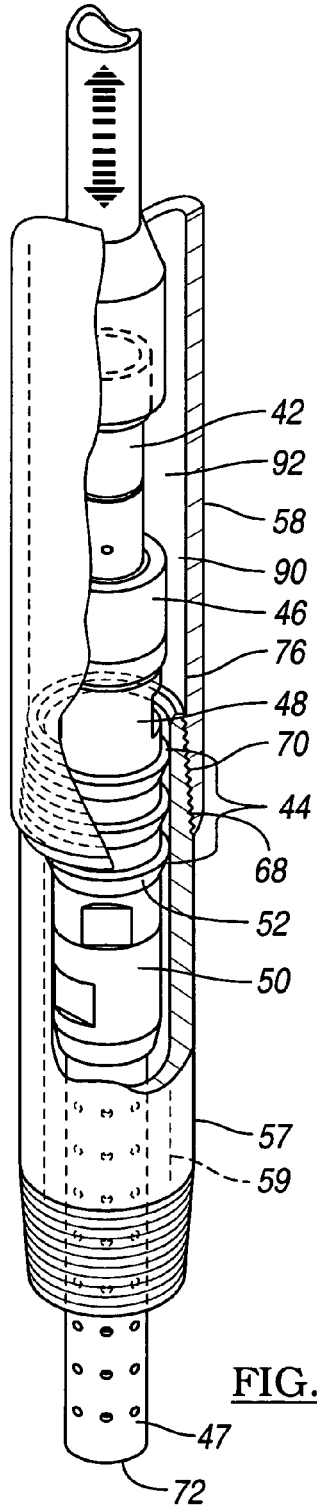
Figure 18A:
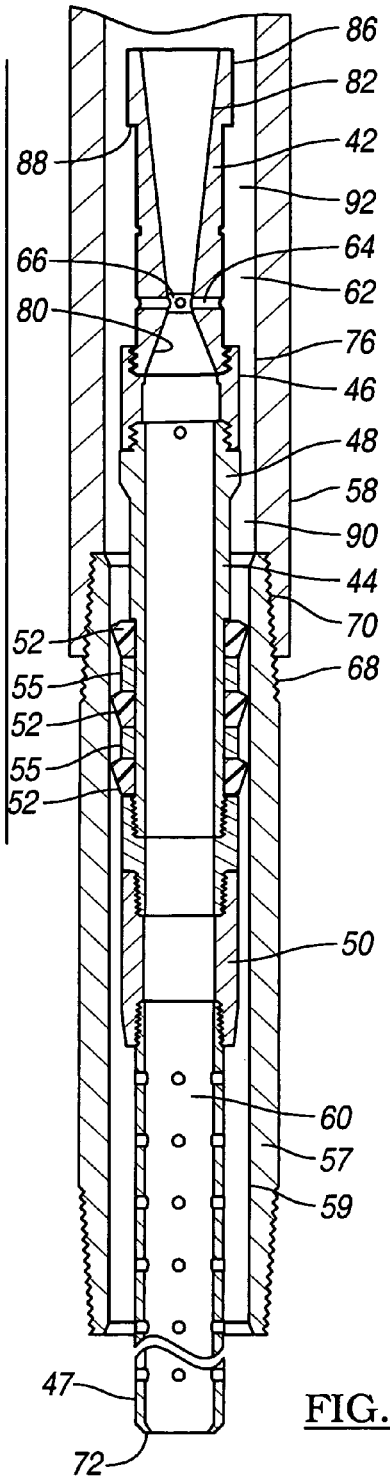
Figure 18B:
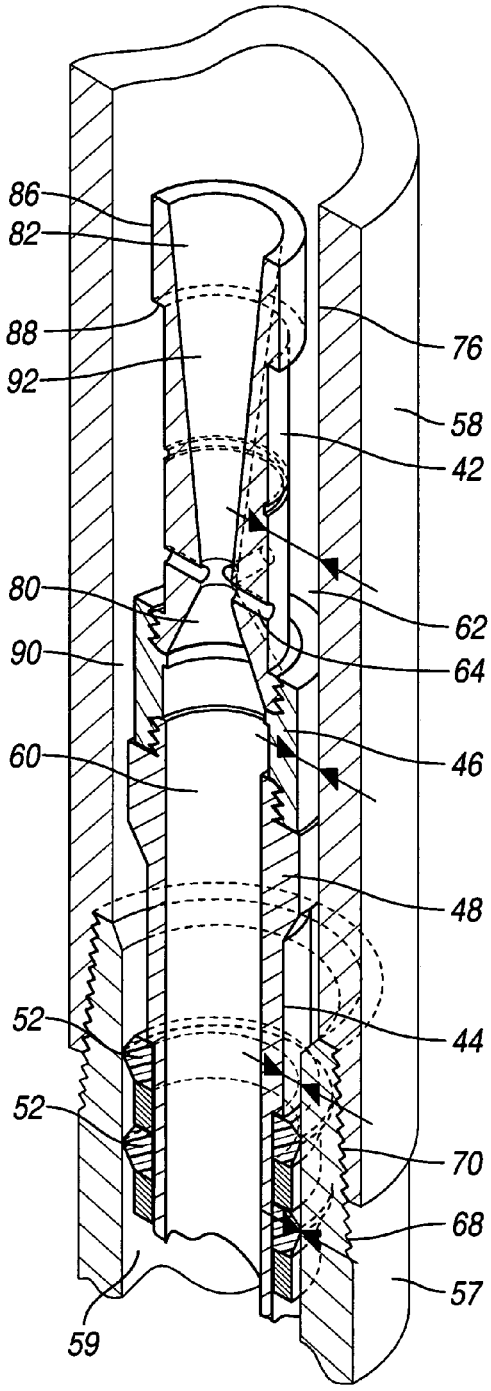
Figure 19A:
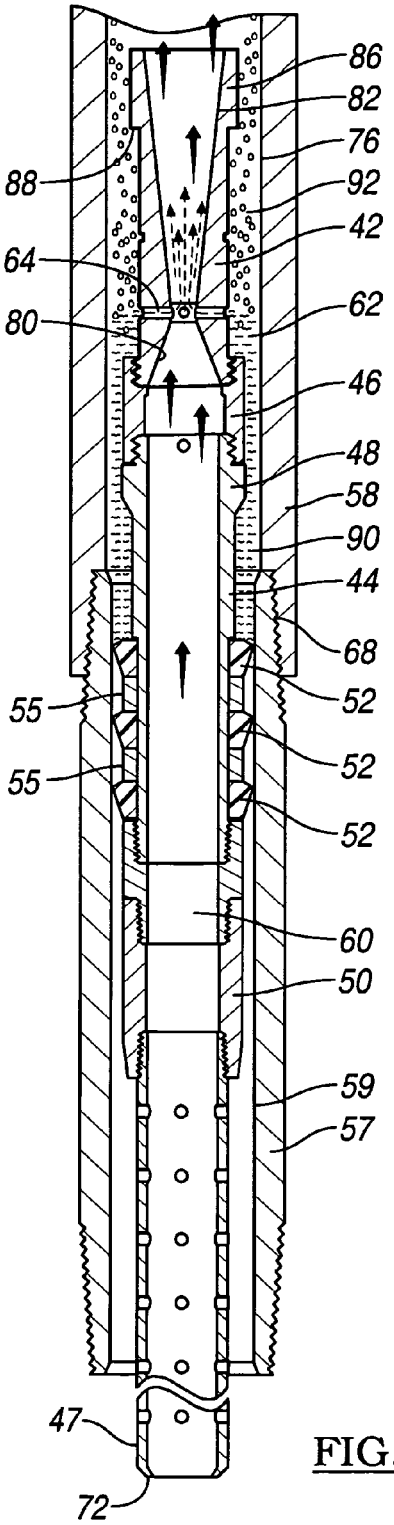
Figure 19B:
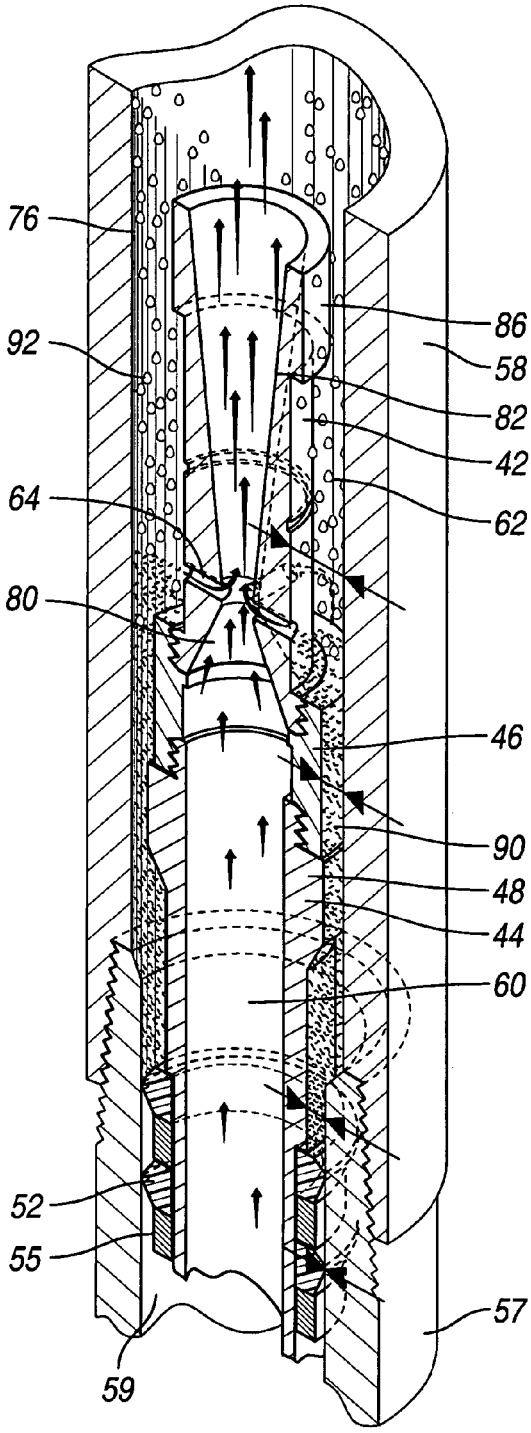
Figure 20:
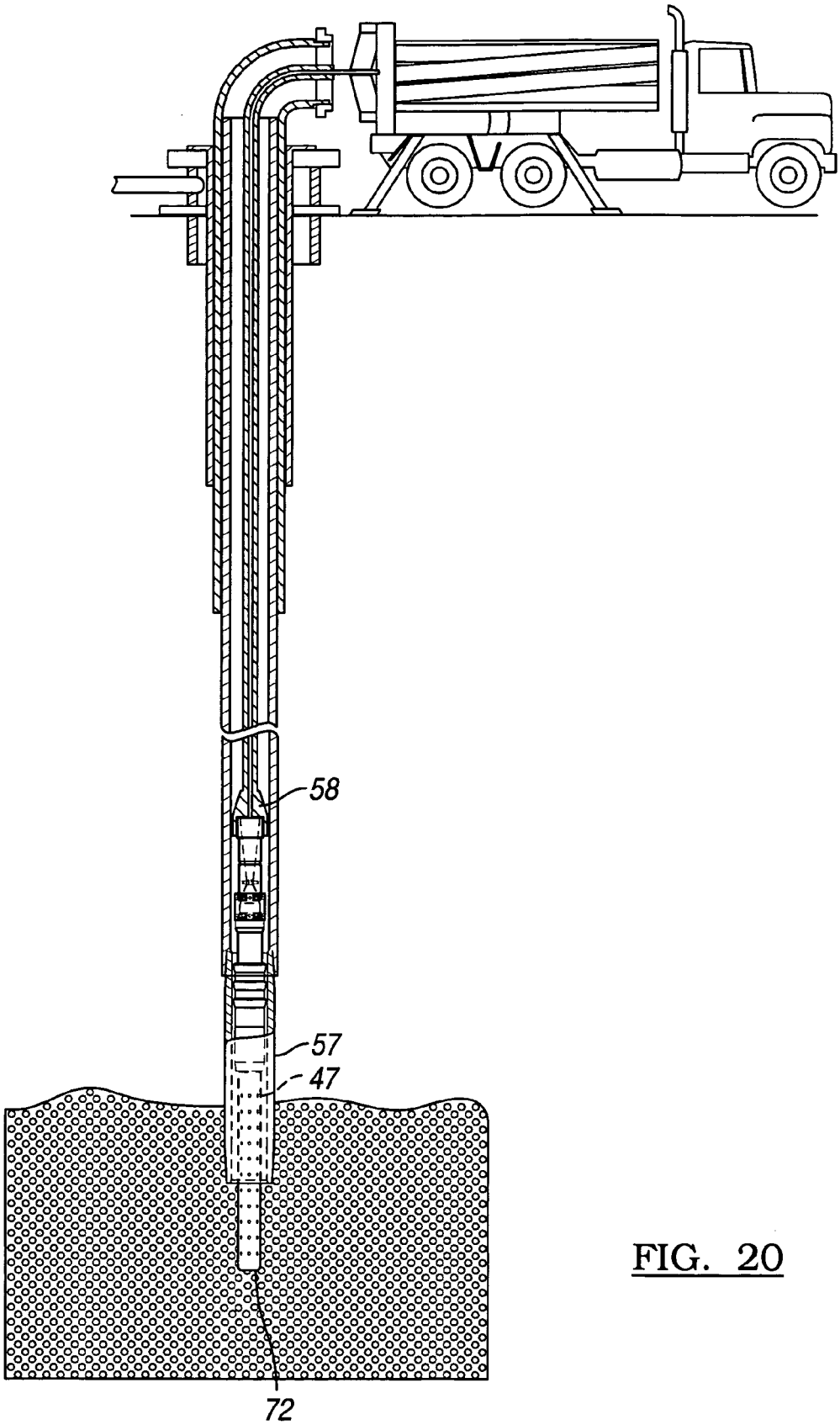

FIGS. 6*a* and 6*b* represent cross-sectional views of FIG. 5 with a further modification of the inventive device;

FIGS. 7*a* and 7*b* represent perspective views of the well device according to the teachings of the present invention;

FIG. 8 represents a close-up side view of the well device installed within a well construction;

FIGS. 9-13 represent cross-sectional views of the well device shown in FIG. 8;

FIG. 14 represents an exploded view of th well device show in FIG. 8;

FIGS. 15*a*-15*d* represent perspective and sectional views of the laval nozzle subassembly used in the well device;

FIGS. 16 and 17 depict the installation of the well device shown in FIG. 8;

FIGS. 18*a* and 18*b* represent cross-sectional views of the well device installed within a landing nipple;

FIGS. 19*a* and 19*b* represent cross-sectional views of a functioning well device according to the teachings of the present invention; and FIG. 20 represents the installation of the well device shown in FIG. 8.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
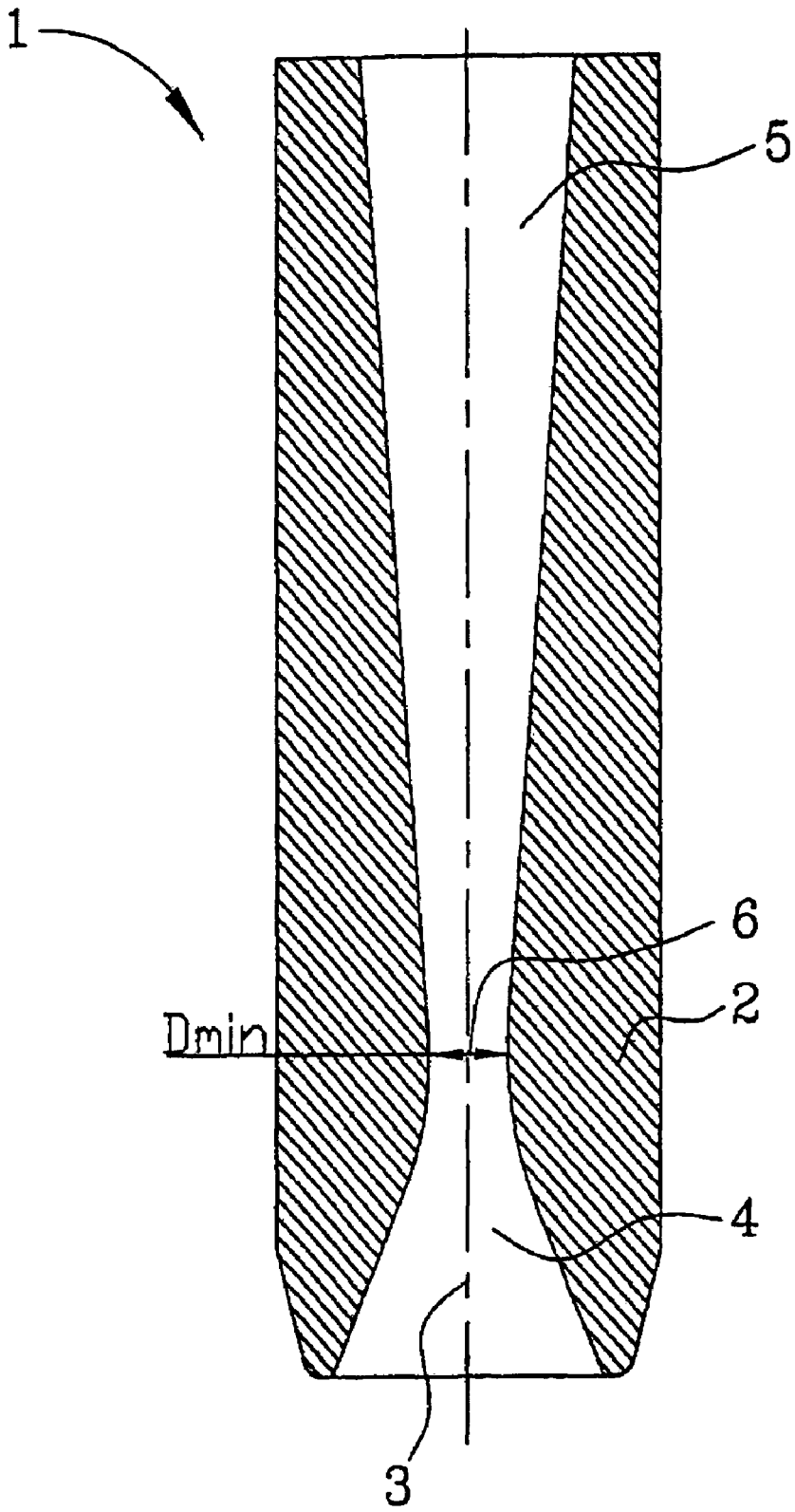
FIG. 1 is a view schematically showing a device for improving recovery of oil and gas in accordance with the present invention.

A device in accordance with the present invention is shown in FIG. 1 and identified as a whole with reference numeral 1. It has a body 2 with a central throughgoing opening 3. The body 2 has a solid, impermeable wall without holes. The throughgoing opening 3 has the shape of laval nozzle. It has a cross-section which changes in an axial direction smoothly, without steps. The opening 3 has two substantially conical parts 4 and 5 which are connected with one another at their narrowest locations 6.

An inlet part 4 of the opening 3 is shorter and it is generally identified as a confuser, while the outer portion 5 is longer and is usually identified with a diffuser. The size of the portions 4 and 5 of the inner opening 3 depends on current parameters of the layer (layer pressure, current pressure of saturation, gas content, water content, porosity, permeability, density of oil, water, gas, etc), and also on parameters of operation of the well (around the clock production, the nature of production oil, water, gas, condensate), an inlet pressure, a size of an inlet nozzle, a pressure in a line, a pressure in a separator, etc.

Based on these parameters, with the use of computer program a specific design of the device is calculated with corresponding sizes, in accordance with which the device is produced.

The device is fixed to mandrels of different types, and with the mandrel it is lowered to a desired calculated depth as close as possible to an interval of perforation. It is fixed and kept hermetically closed by means of mandrel packers and kept in this position to provide the device operation.

When the efficiency of the device is reduced due to significant natural changes in the parameters of the layer, a new device is calculated and made which correspond to new current parameters of the operation of the system the layer-well, and the new device by the mandrel and known means is lowered and replaced the old one.

Figure 2:
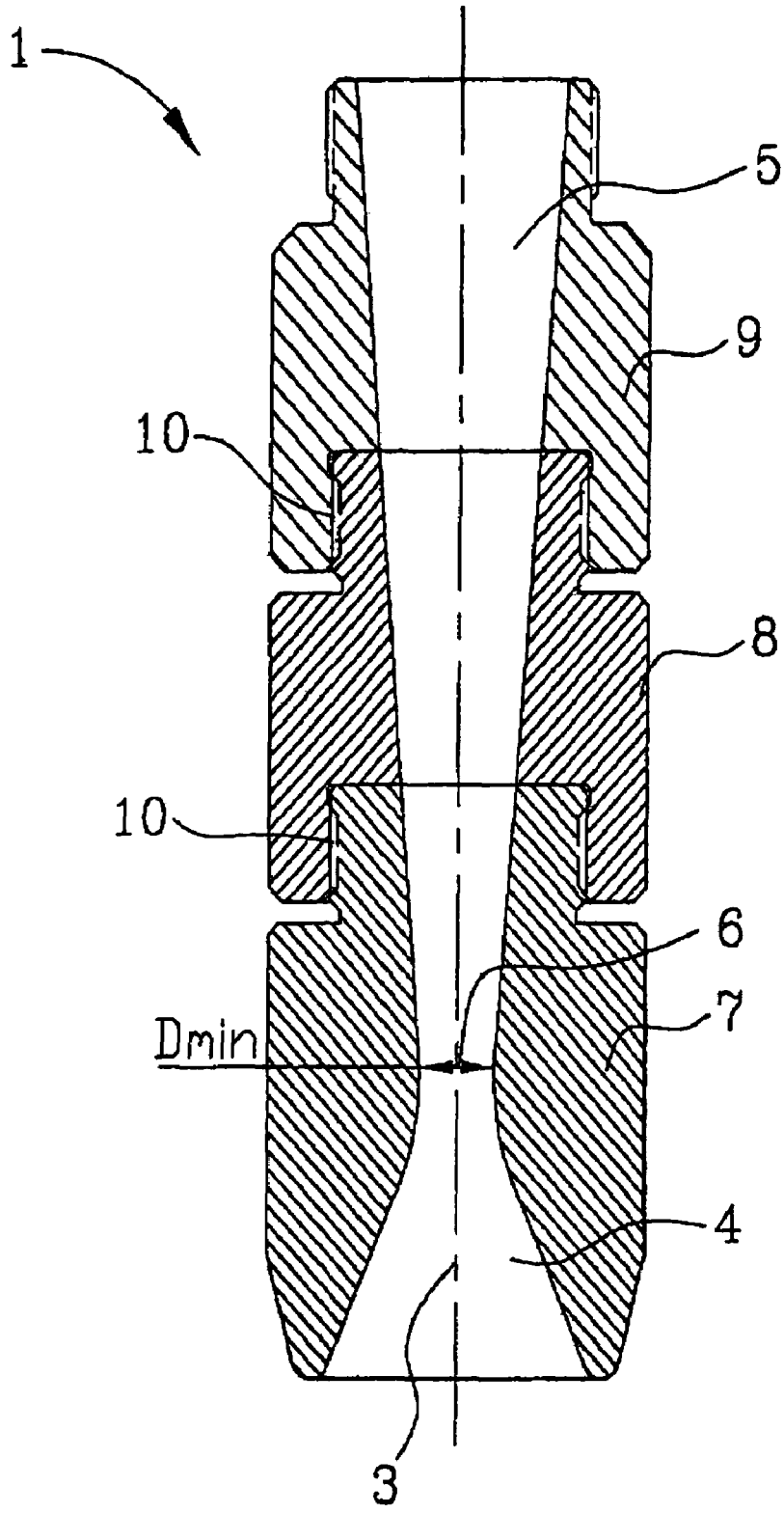
FIG. 2 is a view showing another embodiment of the device composed of several parts.

While in FIG. 1 the device is shown as an integral, single piece part, it can be composed of several parts as shown in FIG. 2. The parts of the device which are identified with reference numerals 7, 8, 9, can be connected with one another by known means, for example by thread 10. Such a device can be easier and simpler to manufacture.

Figure 3:
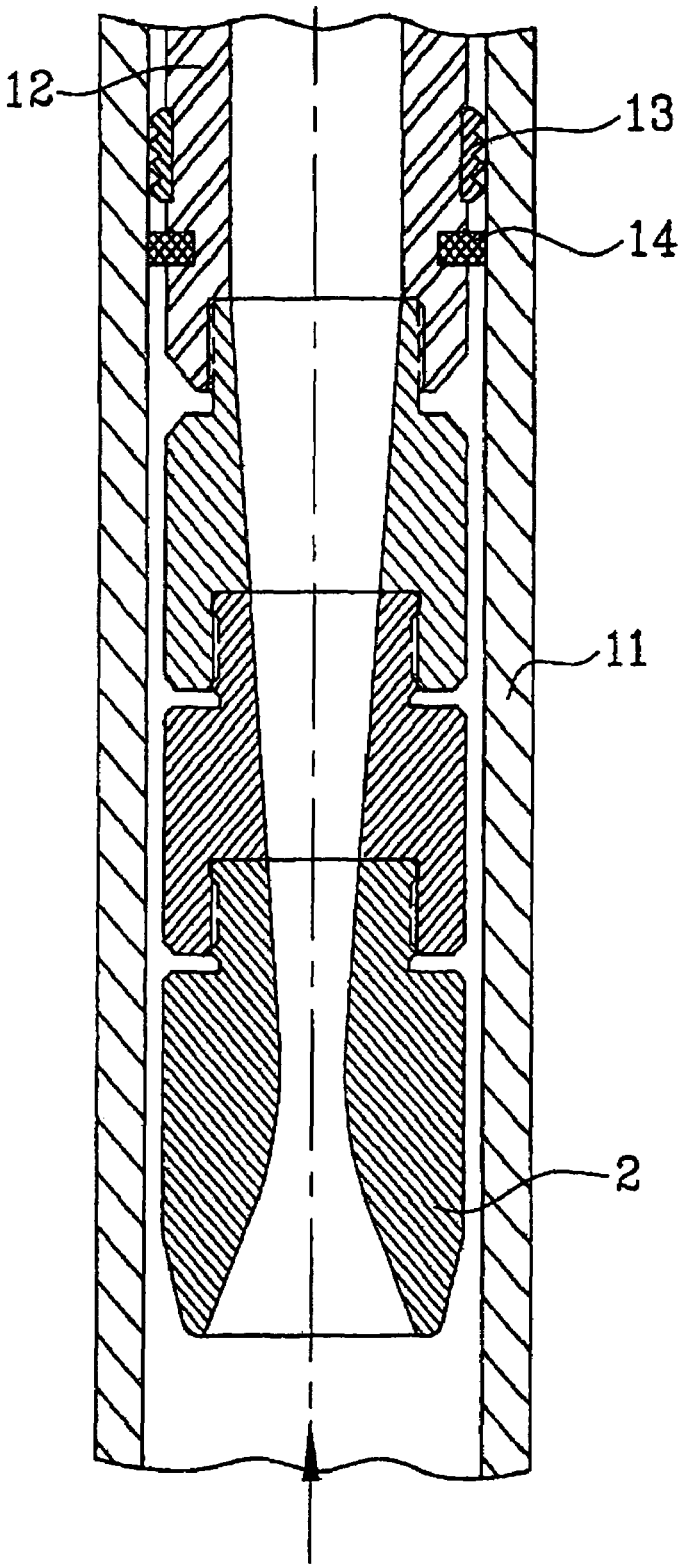
FIG. 3 is a view showing the installation of the inventive device in a well.

FIG. 3 shows an arrangement of the device in the well and its connection with tubing by means of a mandrel. Reference numeral 11 identifies the tubing, reference numeral 12 identifies a mandrel of any type, reference numeral 13 identifies a gripper mechanism of the mandrel, and reference numeral 14 identifies a packer of the mandrel. The body 2 is located below the mandrel 12. The device improves production of oil and gas condensate.

Figure 4:
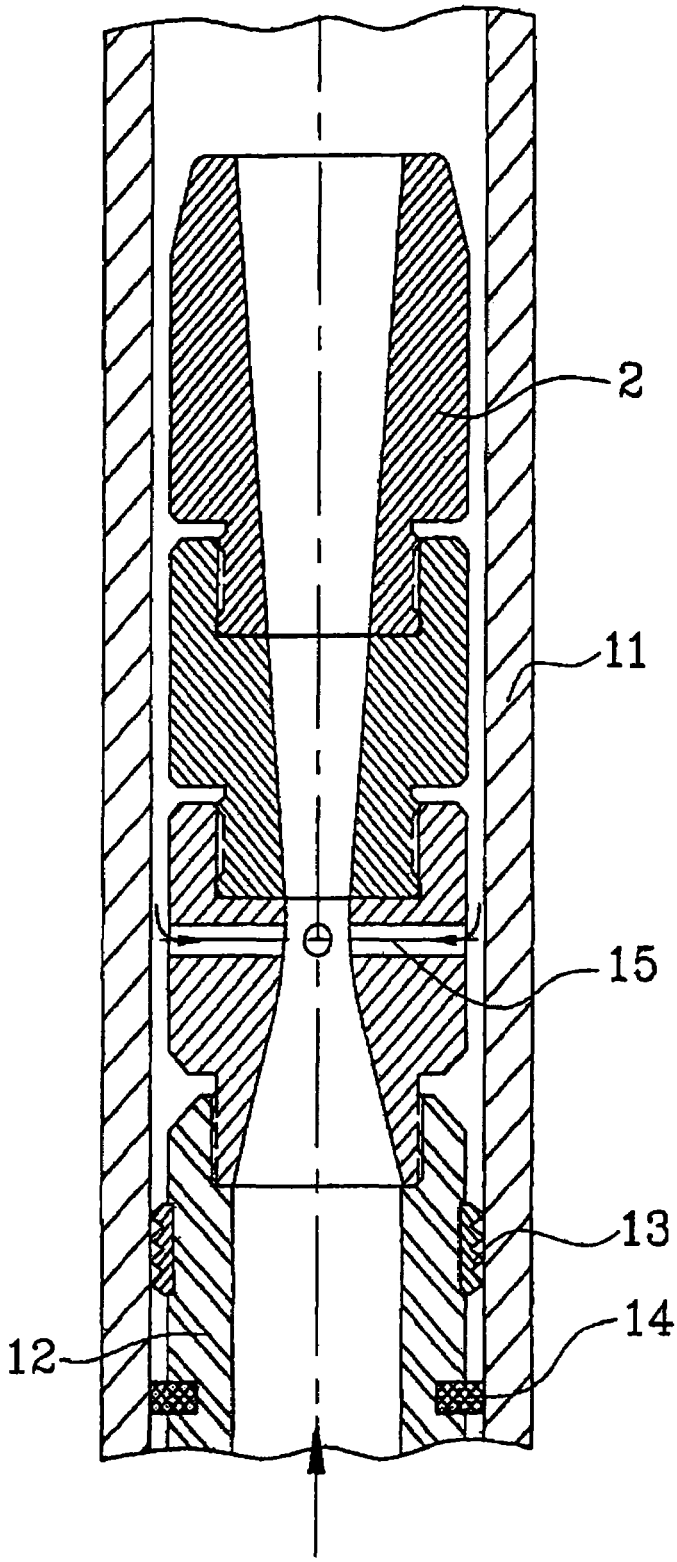
FIG. 4 is a view showing the installation of a second arrangement of the device in accordance with the present invention in a well above the mandrel.

When the device is used for removal of liquid from the bottomhole of gas and gas-condensate wells, the body with horizontal openings 15 is mounted above the mandrel, as shown in FIG. 4, or it is arranged at the end of the tubing without the mandrel by means of another element.

In a further embodiment shown in FIG. 5 the body 2 with the horizontal openings 15 is located below the mandrel and a packer 16 for mounting of the mandrel is provided with a vertical passage 17 formed for example as a longitudinal opening through which liquid and gas condensate can pass and then passing through the horizontal openings.

This device can be installed without these longitudinal opening, also depending on flow conditions.

FIG. 6 shows the cross-section (of packer A-A and horizontal holes B-B) of the second arrangement of the device.

The inventive device generates a completely homogenous gas-liquid flow in a well due to elimination of the stepped zones in a system of Venturi pipes, which create sources of swirling with resulting energy losses. The parameters of the device calculated from current data of the layer and the well can provide accurate forecast without deviations from real conditions of the regulating process and optimization of the system layer-well by the device and the inlet nozzle. The elements of automatic regulation of the bottomhole device are used fuller, a mono-dispersed structure is provided for the gas-liquid flow and it can move toward the inlet of the well without deterioration into gas and liquid, and annular regime mode is not formed. Efficiency of recovery and time of operation of the well with the device significantly increases, so as to increase daily productions of oil and a coefficient of oil recovery as a whole. Liquid is removed from the bottomhole of the well fast and efficient and, therefore, productivity of gas and gas-condensate wells are increased due to reduction of bottomhole pressure to a calculated level.

The advantages of the device in accordance with the present invention can be clearly understood from comparison of a hydraulic calculation of the known apparatus with seven Venturi pipes and a new apparatus, with identical inlet and outlet openings, the total length and length of the narrowest part of the device, with respect to the well Rodador 179 (Mexico).

The well productivity was as follows: oil-138 $m^3$/day, water-56 $m^3$/day or 29%, and gas 31200 $m^3$/day. Bottomhole pressure was 2848 psi, the outlet pressure was 569 psi, with a diameter of the outlet nozzle 26/64, the measured layer pressure was 3020 psi. The depth of the well to the lower holes of perforation was 8423 feet. Oil density was 25 api, water 1.19, gas 0.838.

The prior device with the Venturi pipes before lowering into the well was calculated for pressure drop 107 psi, and the bottomhole pressure had to reduce the depression (difference reservoir and bottomhole pressure) by 15%. The productivity of the well had to be increased also approximately by 15%.

In actuality, after the first test, the yield of oil increased to 153 $m^3$/day or in other words by 11%. The yield of gas and water reduced by 25%. However, as a result of an attempt to increase the oil recovery even more and to reduce content of water during a subsequent regulation of the well, it was not possible to go beyond the range 1/64"÷1.5/64" on adjustable top chock. Negative phenomena appeared in form of a fast drop of gas volume of a main source of energy in this layer. In other words the possibility of regulation of well turned to be very limited.

A calculation of pressure drop in the device in accordance with the present invention shows a drop in the device only by 65 psi. In other words, the magnitude of local resistance in the prior art device was by 42 psi or by 39% greater than in the inventive device. This shows that the calculation for the inventive device is much more accurate The use of the device in accordance with the present invention can Increase the range of regulation at the outlet up to 5/64"÷6/64", and maybe even more, which is extremely important for conditions of significant fluctuations of layer and well parameters during a long time, so as to maintain and optimize the operation of the well when the device is located in the well.

Referring generally to FIGS. 7*a*-14, shown is a well device 40 according to an alternate embodiment. The well device 40 is configured to convert unwanted water within the well system into an atomized vapor or mist, which is transported to the surface by the hydrocarbon stream. The well device 40 has a laval nozzle 42 and a coupling device 44 that is configured to facilitate and regulate the proper installation of the laval nozzle 42 within a well. Disposed between the laval nozzle 42 and the coupling device 44 is a first interface device 46. In this regard, the interface device 46 defines an inner threaded through bore which is configured to mate with a corresponding set of threads on an outer surface of the laval nozzle 42. Optionally, these threads can be integrally formed within the coupling device 44 or can take the form of a separate threaded mounting portion 48.

Disposed at a distal end of the coupling device 44 is a second interface device 50 which is configured to couple an optional filter 47 to the coupling device 44. Centrally disposed through the laval nozzle 42, the coupling device 44, and the filter 47 is a through bore 60. As described in detail below, the through bore 60 is configured to facilitate the transfer of natural gas, well products, and atomized waste water from a well bottom to the well surface.

Disposed on an exterior surface of the coupling device 44 is at least one sealing member 52. The sealing member 52 is configured to sealably interface and lock the coupling device 44 with an interior surface of a well tube. Specifically, the sealing member 52 is configured to interface with an inner surface 59 of a landing nipple 57. The landing nipple 57, as traditionally known in the art, is a tube disposed within the well bottom having a smaller diameter than the tubing 58 traditionally used to extract products from the well. The sealing member 52 can be formed of deformable and compressible hydrocarbon-compatible materials. In the regard, it is envisioned the seal members 52 can be formed of metal or polymers which can withstand the environmental conditions within the well.

As shown in FIG. 8, the sealing members 52 function to fluidly seal and lock the well device 40 into the landing nipple 57. Above the sealing members 52, the coupling device 44 and laval nozzle 42 have an exterior surface having a diameter which is generally smaller than the inner diameter of both the landing nipple 57 and the tube 58. As such, an annular fluid collecting space 62 is defined between the tube 58 and the exterior surface of the device 40. The lower portion of the collecting space 62 is sealed by the sealing members 52.

Defined within the laval nozzle 42 is at least one fluid passage 64, which fluidly couples the annular space 62 and a throat 66 of the nozzle 42. As described further below, the annular space 62 functions to collect unwanted water from the well tube 58 in liquid form. The passages 64 defined in the nozzle 42 function to transport water from the annular space 62 into the throat 66, thus allowing the atomization of the waste water by pressurized hydrocarbons through the nozzle 42. This water vapor is then transported by the flowing hydrocarbon gas to the surface.

Figure 10:
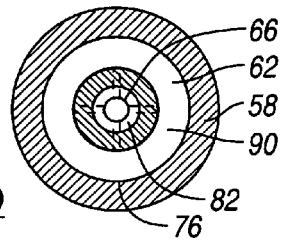
Figure 11:
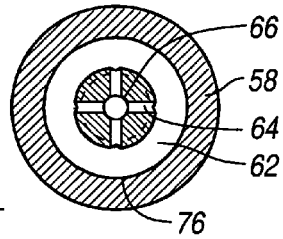
Figure 12:
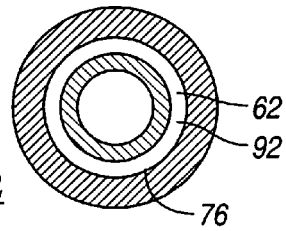
Figure 13:
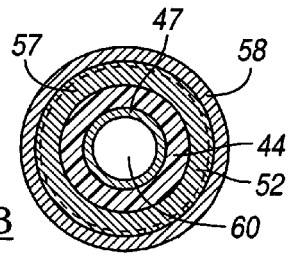

FIGS. 9-13 depict cross-sections of the device 40 shown in a well installation. Shown is the relative positioning of the various nozzle components with respect to the tube 58 and landing nipple 57. As shown in FIGS. 8, 10, and 12, the annular space 62 is divided into two separate portions 90 and 92. The first portion 90 is generally below the passages 64 defined by the nozzle 42 and above the sealing members 52. Any water captured within the annular chamber 90 between the nozzle 42 and the tube 58 is transported through the passages 64 into the throat 66 of the nozzle. FIG. 13 shows that the sealing members 52 function to completely seal and center the device 40 within the landing nipple 57.

FIG. 14 shows and exploded view of the well device 40. Shown is a general construction showing one possible method for positioning the sealing members 52 with respect to the coupling device 44. Disposed between each of the sealing members 52 is a spacer ring 55, which holds the sealing members 52 apart and prevents their transverse movement of the sealing members 52 with respect to the coupling device 44. It is envisioned these spacer rings 55 can be integrally incorporated into the sealing members 52.

Further shown on the top of the coupling device 44 is the coupling device mounting portion 48. The coupling device mounted portion 48 has a threaded portion which functions to threadingly engage the laval nozzle 42. It should be noted that, when installed, the laval nozzle 42 is generally positioned above the coupling portion 44 so as to define the annular space 62 between the device 40 and the interior surface of the tube 58. Furthermore, the location of the laval nozzle 42 allows for the installation or extraction of the nozzle member from within the landing nipple 57. Disposed on a proximal end of the laval nozzle 42 is a fixation mechanism 86. The fixation mechanism 86 defines a transverse ledge 88, which is used by an insertion tool (not shown) which is releasably coupled to the device for installation.

Figure 15A:
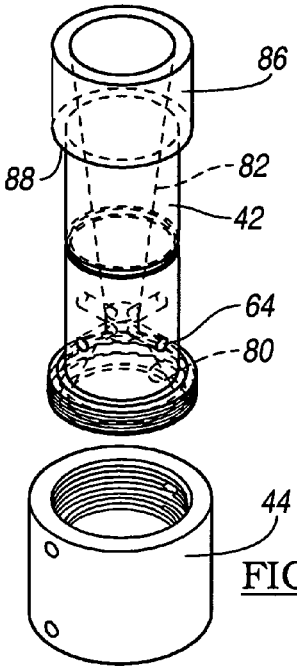
Figure 15B:
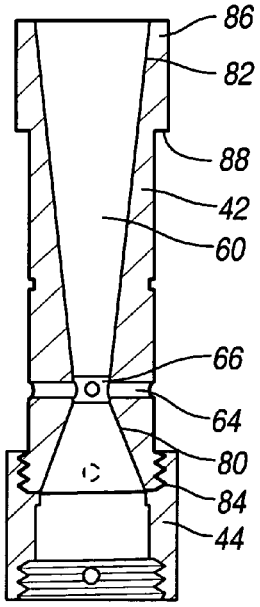
Figure 15C:
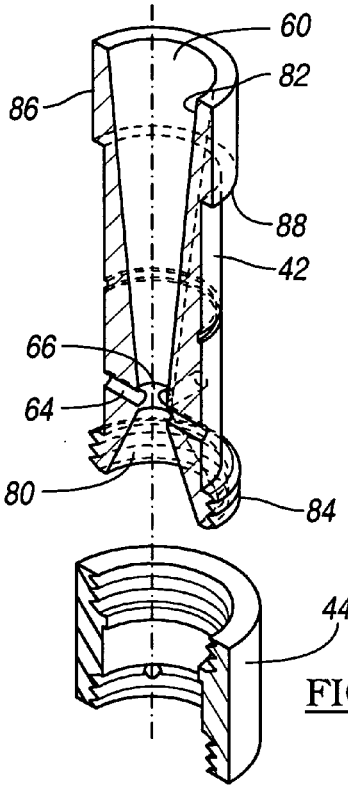
Figure 15D:
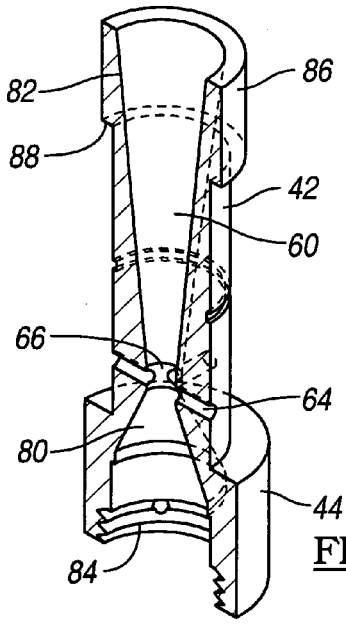

FIGS. 15*a*-15*b* depict perspective and cross-sectional views of optional laval nozzles 42. As previously mentioned, the exact configuration of a laval nozzle first confuser cone 80 and second diffuser cone 82 will depend on the specifics of the environmental conditions in the well bottom. In this regard, the length and curvature or angularity of the specific cones 80, 82 will depend on specific gas parameters and loading within the well. As shown in FIGS. 15*b* and 15*d*, the associated coupling device 44 can either be integral with the laval nozzle 42 or can be a stand alone separate member.

FIGS. 16 and 17 depict the insertion of the well device 40 within the well construction. As can be seen, the well device 40 is inserted using an insertion mechanism 94 so as to position the sealing members 52 within the inner surface 59 of the landing nipple 57. It is envisioned that the device 40 has a length which is longer than the length of the landing nipple 57. As such, the filter 47 is disposed below a lower surface 72 of the landing nipple 57. The perforated construction as well as the location of the filter 47 allows for the maximum transport of gas from the well without having to worry about the interference of excess or extraneous water found in the well bottom. The filter 47 is located both within and outside of the landing nipple 57.

FIGS. 18*a* and 18*b* represent cross-sectional views of the well device 40 inserted within the well. Shown is a specific configuration and location of the various components within the system. Specific note should be directed to the location of the filter 47 with respect to the inner surface 59 of the landing nipple 57. In this regard, an annular chamber 96 is formed so as to allow the maximum input of gas into the through bore 60 under many different well operating conditions.

FIGS. 19*a* and 19*b* show the functioning of the well device 40. In this regard, the gas 98 is shown flowing through the through bore 60. Unwanted excess water has been trapped within the annular cavity 62 by the sealing members 52. The nozzle 42 is positioned downstream with respect to gas flow in the well from the coupling device 44 and the filter 47. When the first chamber portion 90 of the annular space 62 fills, water is transferred into the throat 66 of the laval nozzle 42 through the passages 64 defined within the nozzle 42. A mixture of gas 98 and atomized water 100 is pushed by the gas pressure through the nozzle second diffuser cone 82 and up to the well surface. The device 40 advantageously provides for an efficient method to remove waste water which condenses or is transported by the inner surface 76 of the tube 58.

FIG. 20 represents the use of a wire line truck 106 to insert the well device 40. As can be seen, a wire line 104 is coupled to the removable locking mechanism 94. The wire line 104 is used to lower the device and, in combination with gravity, to insert the device within the landing nipple. Weights are then used to impact the locking mechanism 94 to drive the device 40 into the landing nipple. After setting the device, the wire line 104 and removable locking device 94 have been removed from the well. The well is "swabbed" to remove unwanted water. In this regard, it is envisioned that high pressure gas would be used to force water from the system through the device 40 into the well bottom. Alternatively, water can be removed from the system prior to the insertion of the well device 40. Once the water is removed, the hydrocarbon well products move through the central throughbore 60 and are retrievable from the well. The device can similarly be removed from the well using the locking device 40.

It will be understood that each of the elements described above, or two or more together, may also find a useful application in other types of constructions differing from the types described above. While the invention has been illustrated and described as embodied in device for improving oil and gas recovery in wells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A well device configured to be installed through well tubing having a first inner diameter into a landing nipple having a second inner diameter, the well device comprising:

a member defining a laval nozzle;

a coupling portion fluidly coupled to the laval nozzle; and a plurality of sealing members annularly disposed about the coupling portion having an outer diameter smaller than the first inner diameter and larger than the second inner diameter, wherein said sealing members are adapted to resist movement of the coupling portion with respect to the landing nipple.

2. The well device according to claim 1, wherein said member has an outer diameter which is smaller than an inner diameter of the well tubing, so as to define a water collecting cavity therebetween.

3. The well device according to claim 2, wherein said laval nozzle is located fluidly downstream within the well from the sealing members.

4. The well device according to claim 2, wherein said member defines at least one aperture configured to fluidly couple the water collecting cavity with the laval nozzle.

5. The well device according to claim 4, wherein the aperture fluidly couples the water collecting cavity with a throat of the laval nozzle.

6. The well device according to claim 1, further comprising a filter member fluidly coupled to said coupling portion.

7. A well device for use in a well having a first tube with a first inner diameter and a landing nipple defining a bore having a second inner diameter which is smaller than the first inner diameter, said well device comprising:

a member defining a laval nozzle and a tool engaging portion; and a means for coupling the laval nozzle to the bore of the landing nipple, and for defining a water collection cavity, wherein said member defines a through passage which fluidly couples the collection cavity with the laval nozzle, wherein the tool engaging portion defines a coupling region having a traverse surface.

8. The device according to claim 7, wherein the member is fluidly downstream from the means for coupling the laval nozzle.

9. The well device according to claim 8, further comprising a filter fluidly coupled to the laval nozzle.

10. The well device according to claim 9, wherein the filter is a perforated member defining a through bore.

11. The well device according to claim 7, wherein the means for coupling the laval nozzle is configured to position the laval nozzle above the landing nipple in the direction of flow.

12. A well construction comprising:

a well tubing having a through bore with a first inner diameter;

a landing nipple defining a second through bore having a second inner diameter smaller than the first inner diameter; and a well device having a member defining an insertion tool engaging surface and a laval nozzle and a coupling member defining a third through bore fluidly coupled to the laval nozzle, said coupling member having a plurality of compressible sealing members configured to fluidly seal said second through bore and support the coupling member in the landing nipple, wherein said member is disposed above the landing nipple in the direction of flow.

13. The well construction according to claim 12, wherein the member defines a first portion having a first diameter, a second portion having a second diameter, and a tool engaging surface therebetween.

14. The well construction according to claim 12, wherein the well device further comprises a filter.

15. The well construction according to claim 14, wherein the well device has a length larger than a length of the landing nipple.

16. A device for improving recovery of hydrocarbons from a well, the device comprising:

a well having first and second tubes, said first tube having a first inner diameter which is larger than an inner diameter of the second tube;

a body defining a central throughgoing opening with a shape corresponding to a laval nozzle, said laval nozzle having a cross-section that is changed steplessly and gradually; and a coupling member having a plurality of sealing rings coupled to said body configured to couple said body to said second tube, said body being located outside said coupling member in a position above said coupling member in the direction of flow, wherein an annular cavity is formed between the body and the first tubing, and said body defines a passage to fluidly couple the annular cavity to the laval nozzle, further comprising means for connecting said body hermetically with said coupling member for joint lowering into a well, arrangement on a desired depth, hermetization and lifting of said body for replacement of the device.

17. The device a defined in claim 16, wherein said body is formed as an integral, one-piece element provided with said throughgoing opening having said shape and said cross-section.

18. The device as defined in claim 16, wherein said body further comprises a means for removing liquid from a low pressure zone and transporting it to the central opening.

* * * * *